US006824408B1

(12) United States Patent
Wu

(10) Patent No.: US 6,824,408 B1
(45) Date of Patent: Nov. 30, 2004

(54) CABLE END CONNECTOR ASSEMBLY HAVING PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/607,774

(22) Filed: Jun. 27, 2003

(51) Int. Cl.[7] ..... H01R 13/62; H01R 13/00
(52) U.S. Cl. ..... 439/160; 439/484
(58) Field of Search ..... 439/160, 483, 439/484

(56) References Cited

U.S. PATENT DOCUMENTS 3,431,535 A * 3/1969 Munyon ..... 439/484
4,379,361 A 4/1983 Webster et al.
4,586,768 A * 5/1986 Eck ..... 439/160
4,881,911 A 11/1989 Haddock et al.
6,074,237 A 6/2000 Lee
6,126,479 A 10/2000 Lee
6,132,241 A 10/2000 Hwang
6,416,353 B1 7/2002 Hwang et al.

* cited by examiner

*Primary Examiner*—Chandrika Prasad
(74) *Attorney, Agent, or Firm*—Wei Te Chung

(57) ABSTRACT

A cable end connector assembly (1) includes an insulative housing (2), a number of electrical contacts (6) received in the insulative housing, a cable (4) electrically terminated with the electrical contacts, an insulative cover (3) assembled to the insulative housing, and a pull tab (5). The insulative cover includes a first face (316) engaging with the cable and an opposite second face (318). The pull tab is assembled to the cover and wraps the second face of the cover.

13 Claims, 10 Drawing Sheets

CABLE END CONNECTOR ASSEMBLY HAVING PULL TAB

CROSS-REFERENCE TO RELATED APPLICATIONS

Relevant subject matter is related to copending U.S. patent application with an unknown serial number and entitled "CABLE END CONNECTOR ASSEMBLY HAVING PULL TAB", invented by the same inventor and assigned to the same assignee as this application.

BACKGROUND OF THE INVENTION

1. Field of the Invention

The present invention generally relates to a cable end connector assembly, and more particularly to a cable end connector assembly having a flexible pull tab.

2. Description of Related Art

It is well known that a cable end connector assembly comprises a cable end connector and a cable electrically terminated to the cable end connector. The cable end connector assembly is usually matable with a complementary connector for transmitting signals from the cable to the complementary connector.

However, a panel of a chassis to which the complementary connector is mounted may have so many components mounted thereon that an operator can only the pull the cable of the cable end connector assembly to separate the cable end connector assembly from the complementary connector if there is no additional device. This may cause wires of the cable be divorced from contacts of the cable end connector, and thus, influences the signal transmission between the cable end connector assembly and the complementary connector inevitably. To solve this problem, different kinds of pull mechanisms are designed. For example, U.S. Pat. Nos. 4,379,361, 6,126,479 and 6,416,353 each disclose a pull tab or pull mechanism to solve the problem mentioned above.

U.S. Pat. No. 4,379,361 discloses a pull tab received in a housing of a cable termination assembly and having a plurality of openings for receiving respective deformed parts of signal conductors of a cable. This kind of pull tab is difficult to assemble to the cable termination assembly and the structure thereof is relatively complex.

U.S. Pat. No. 6,416,353 discloses an IDC (Insulation Displacement Connection) connector assembly which comprises a housing, a cable terminated to contacts received in the housing, a first cover assembled to the housing and the cable, and a second cover assembled to the first cover and the housing and functioning as a pull mechanism for separating the connector assembly from a complementary connector. However, the occupied space of the second cover is relatively big for some special applications.

U.S. Pat. No. 6,126,479 discloses an IDC connector assembly which comprises an elongated housing containing a plurality of contacts therein, a cable electrically terminated to the contacts, an elongated cover assembled to the housing and the cable, and a flexible pull tab received in a slot defined between longitudinal sides of the cover. The elongated cover needs to be high enough for ensuring a rigidity thereof and for resisting a pulling force exerted on the pull tab, so it is still undesirable for some special circumstances.

Hence, a cable end connector assembly with an improved pull tab structure is needed to address the problems encountered in the related art.

SUMMARY OF THE INVENTION

An object of the present invention is to provide a cable end connector assembly having a pull tab for separating the cable end connector assembly from a complementary connector more conveniently.

Another object of the present invention is to provide a cable end connector assembly which is simple in structure and easy to manufacture.

In order to achieve the objects set forth, a cable end connector assembly in accordance with the present invention comprises an insulative housing, a plurality of electrical contacts received in the insulative housing, a cable electrically terminated with the electrical contacts, an insulative cover assembled to the insulative housing, and a pull tab. The insulative cover comprises a first face engaging with the cable and a second face opposite to the first face. The pull tab is assembled to the cover and wraps the second face of the cover.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
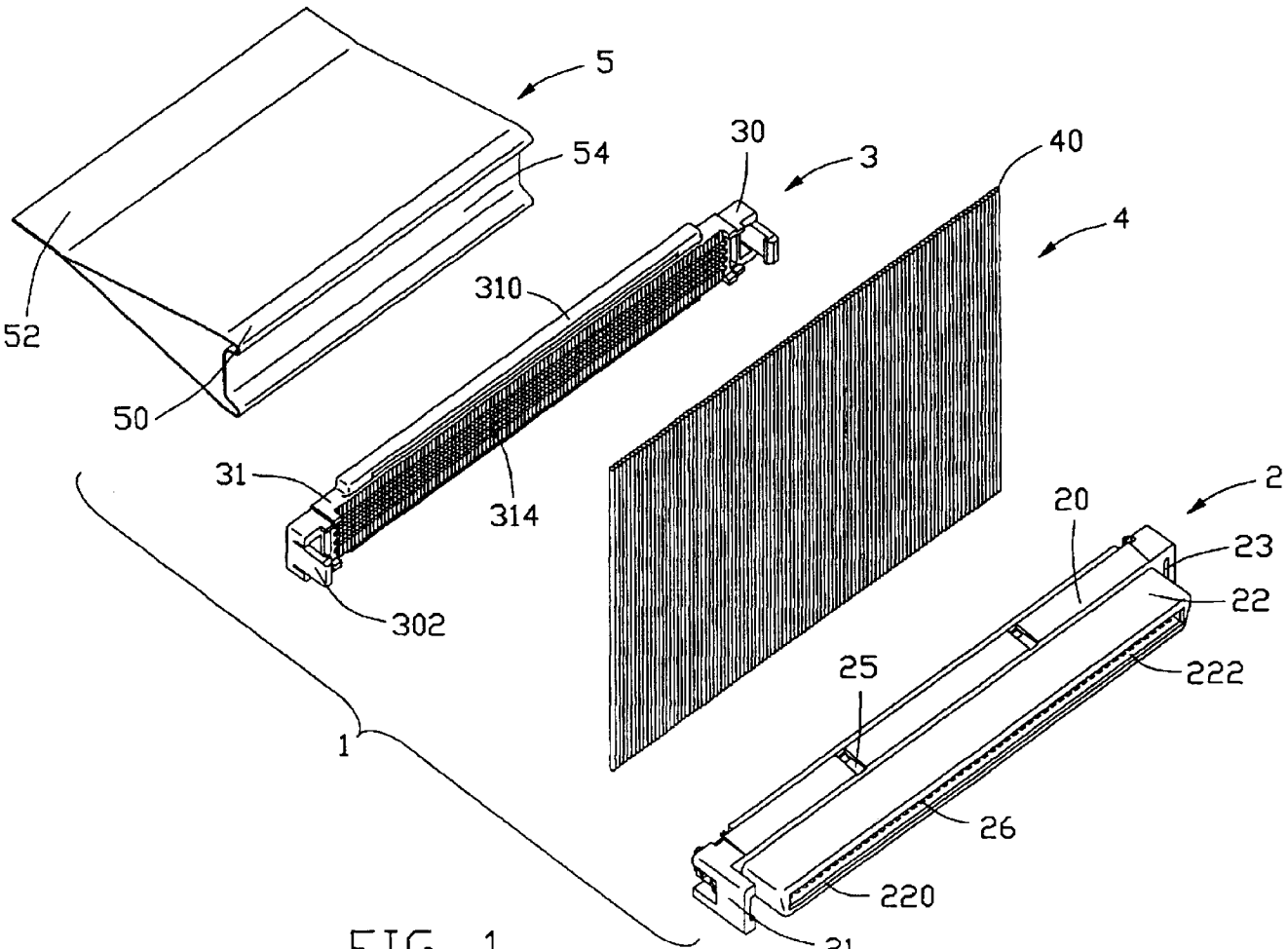
FIG. 1 is a partially exploded, perspective view of a cable end connector assembly in accordance with the present invention.
Figure 2:
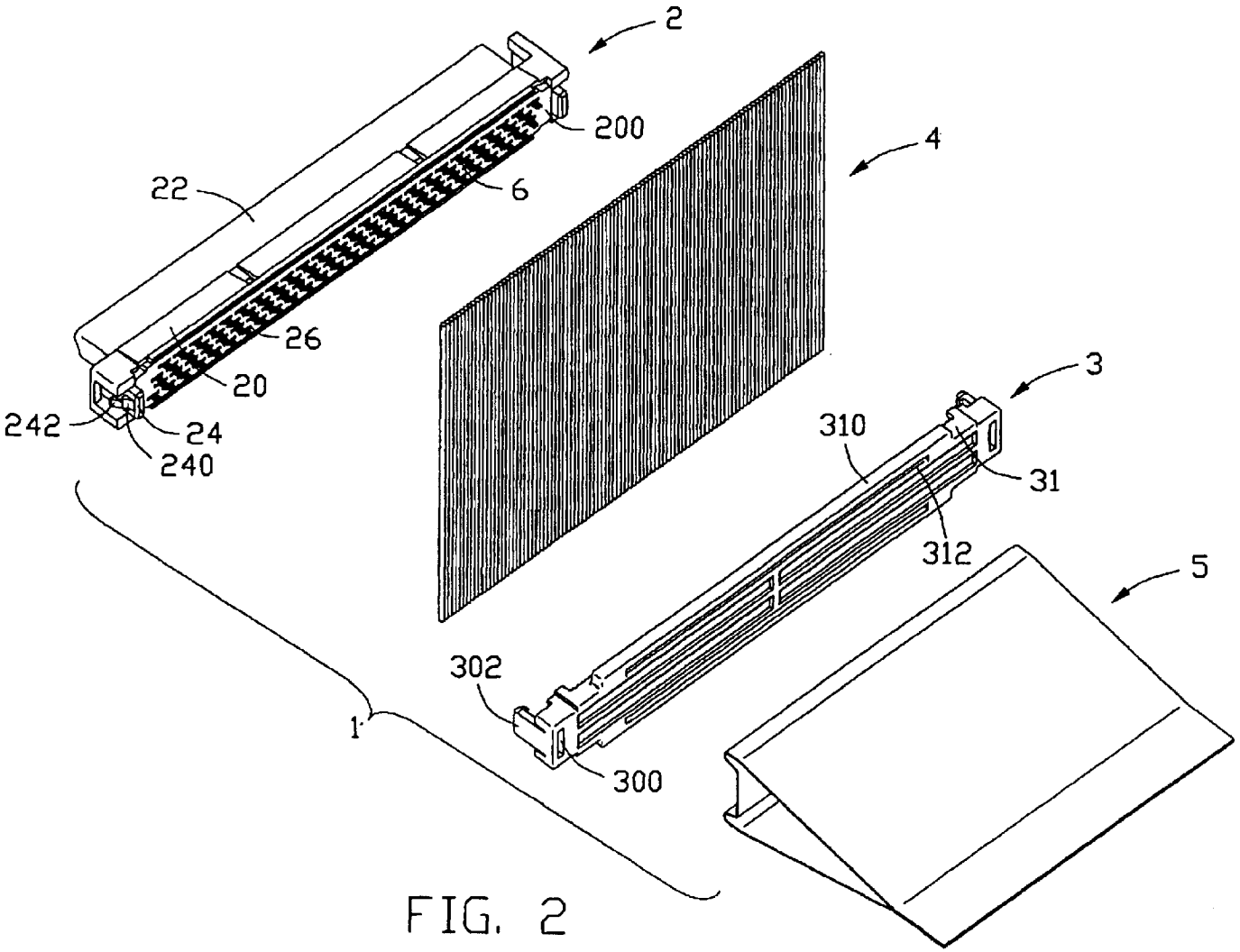
FIG. 2 is a view similar to FIG. 1, but taken from a different aspect.

Referring to FIG. 1 and FIG. 2, a cable end connector assembly 1 in accordance with the present invention comprises an elongated insulative housing 2, a plurality of electrical contacts 6 received in the insulative housing 2, a cover 3 securely attached to the insulative housing 2, a cable 4 and a pull tab 5.

Continuing to FIG. 1 and FIG. 2, the insulative housing 2 comprises a base 20 and a D-shaped mating portion 22 protruding from a center of the base 20. The insulative housing 2 also comprises a mating face 220 and a termination face 200 opposite to the mating face 220. A pair of slits 23 is respectively defined in opposite lateral ends of the base 20. A transverse U-shaped guiding post 21 extends forwardly from one of the lateral ends of the base 20. A pair of engaging portions 24 extends outwardly from the pair of opposite lateral ends of the base 20, respectively. Each engaging portion 24 is formed with a first and a second retaining wedges 240, 242. A pair of grooves 25 is respectively defined in opposite outer surfaces of the base 20. A receiving space 222 is defined rearwardly from the mating face 220 of the insulative housing 2 to form a continuous periphery wall (not labeled). A plurality of passageways 26 is defined in the periphery wall of the insulative housing 2 and extends from the termination face 200 toward the mating face 220 of the insulative housing 2.

Figure 9:
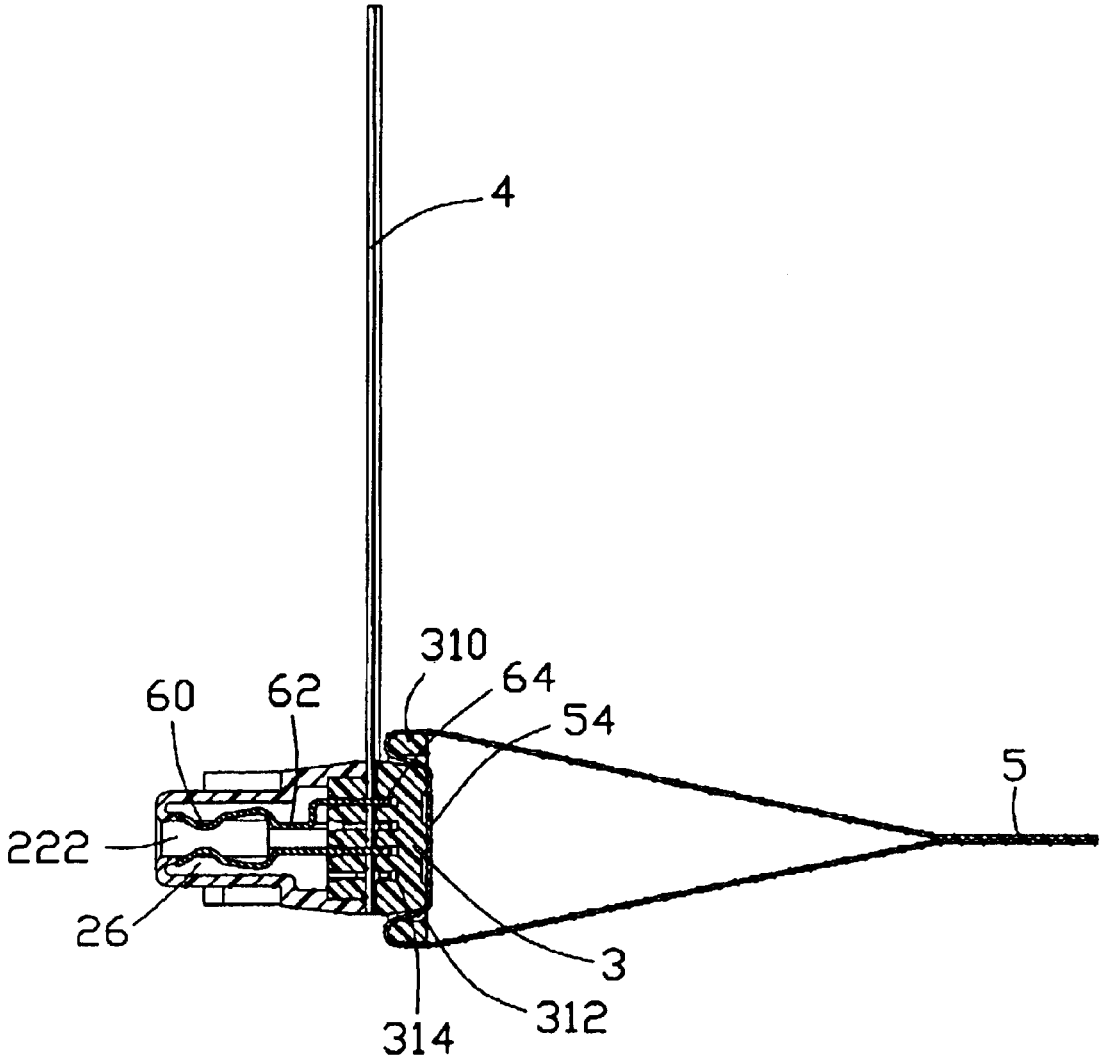
FIG. 9 is a cross-sectional view of the cable end connector assembly taken along line 9—9 of FIG. 5.
Figure 10:
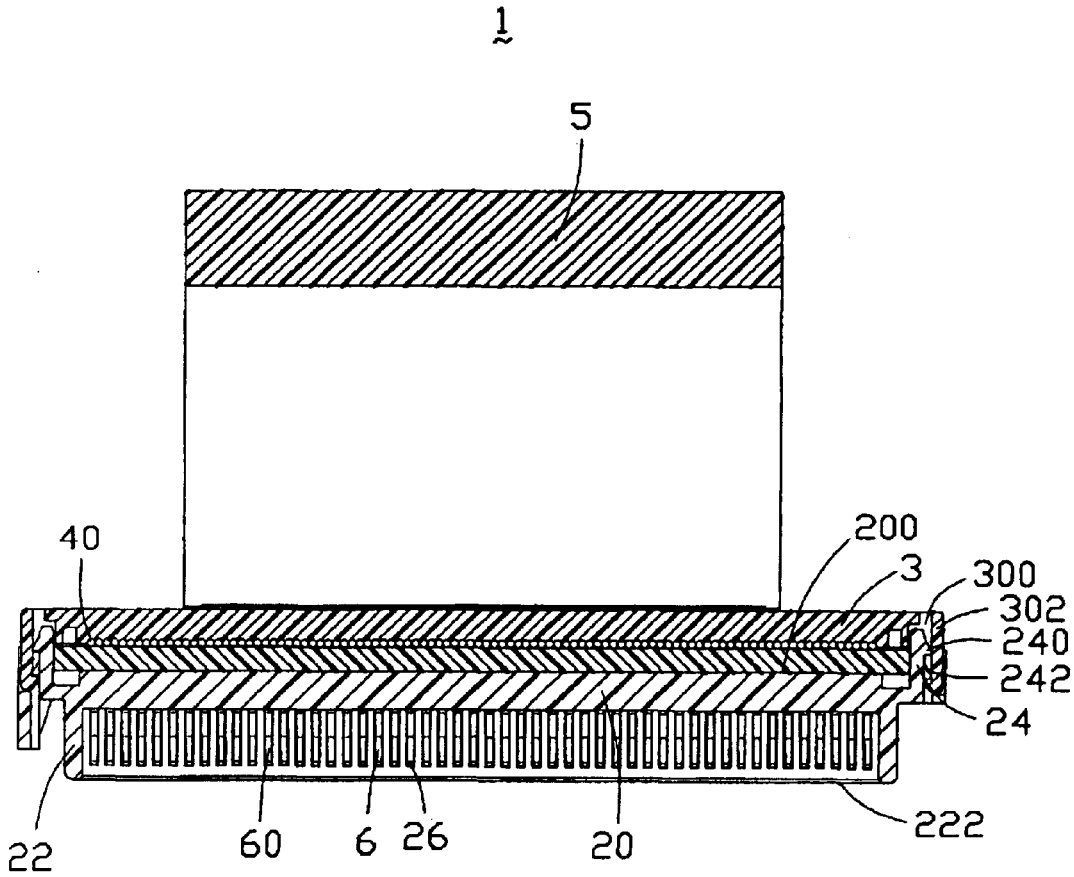
FIG. 10 is a cross-sectional view of the cable end connector assembly taken along line 10—10 of FIG. 5.

Together referring to FIG. 9, each of the electrical contacts 6 comprises a contacting portion 60 received in a corresponding passageway 26 of the insulative housing 2 for electrically connected to the complementary connector, an insulation displacement portion 64 opposite to the contacting portion 60 and exposed outside the termination face 200, and a retention portion 62 interconnecting the contacting portion 60 and the insulation displacement portion 64 and interfering with inner surfaces of the corresponding passageway 26.

Figure 3:
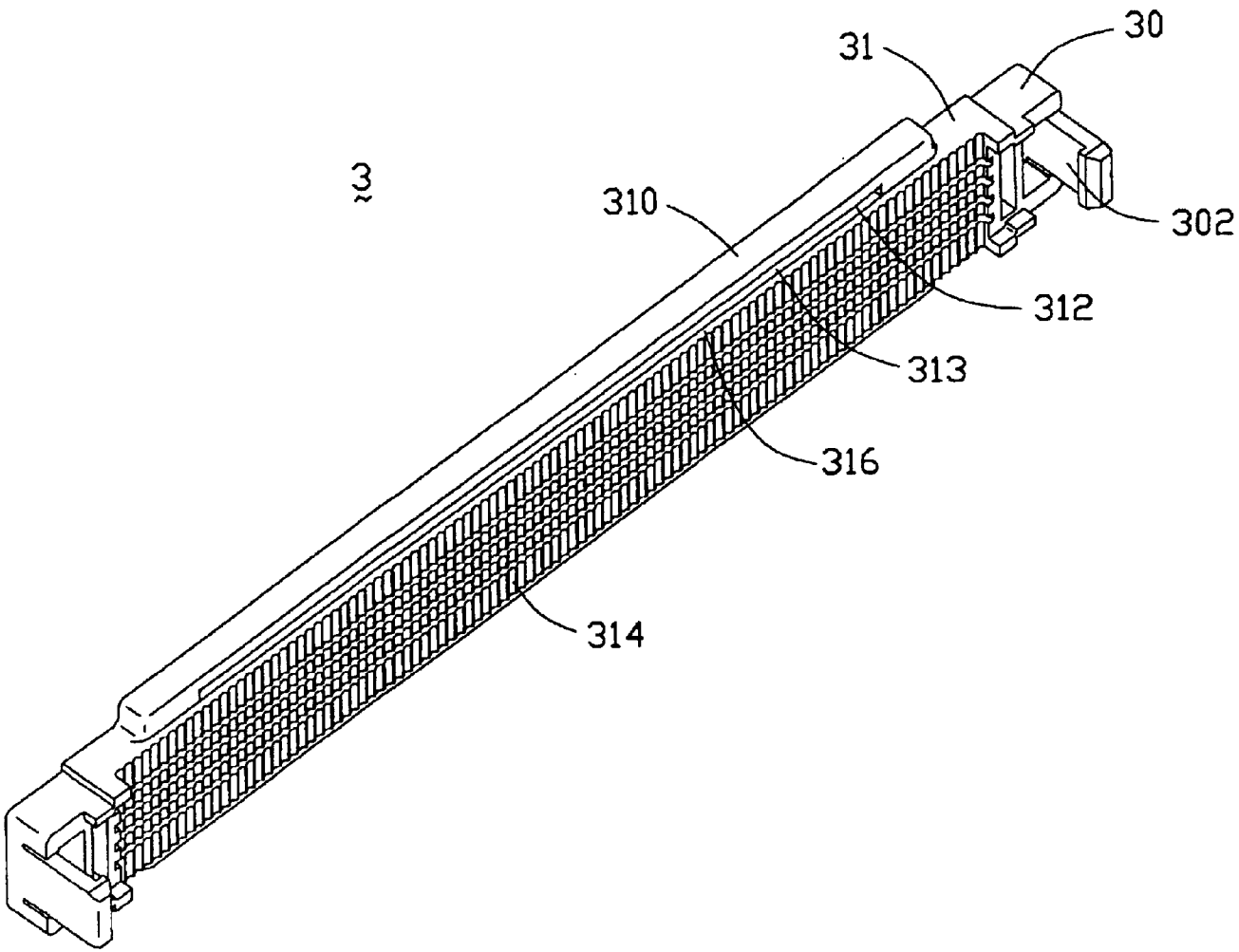
FIG. 3 is a perspective view of a cover of the cable end connector assembly.
Figure 4:
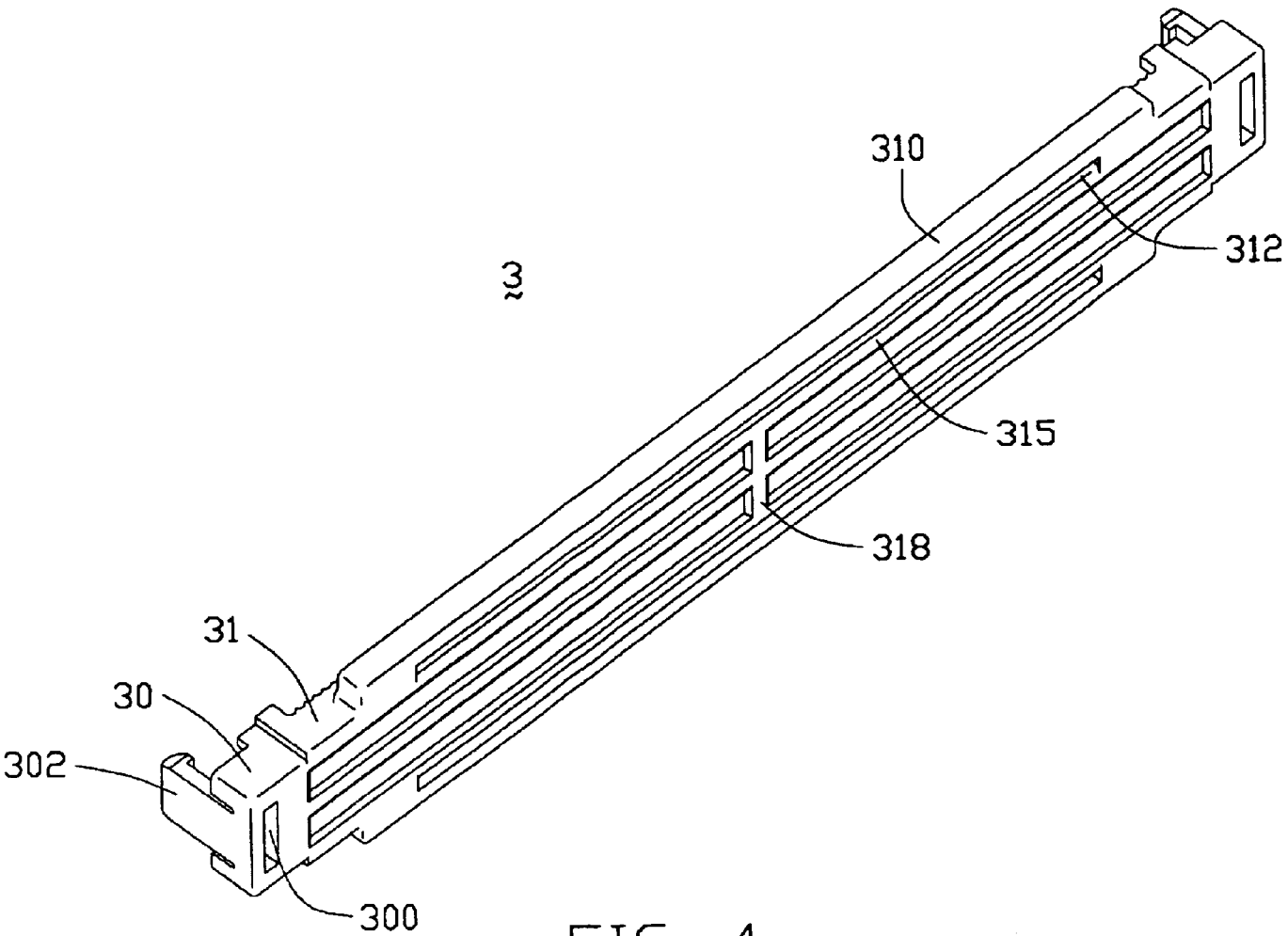
FIG. 4 is a view similar to FIG. 3, but taken from a different aspect.
Figure 5:
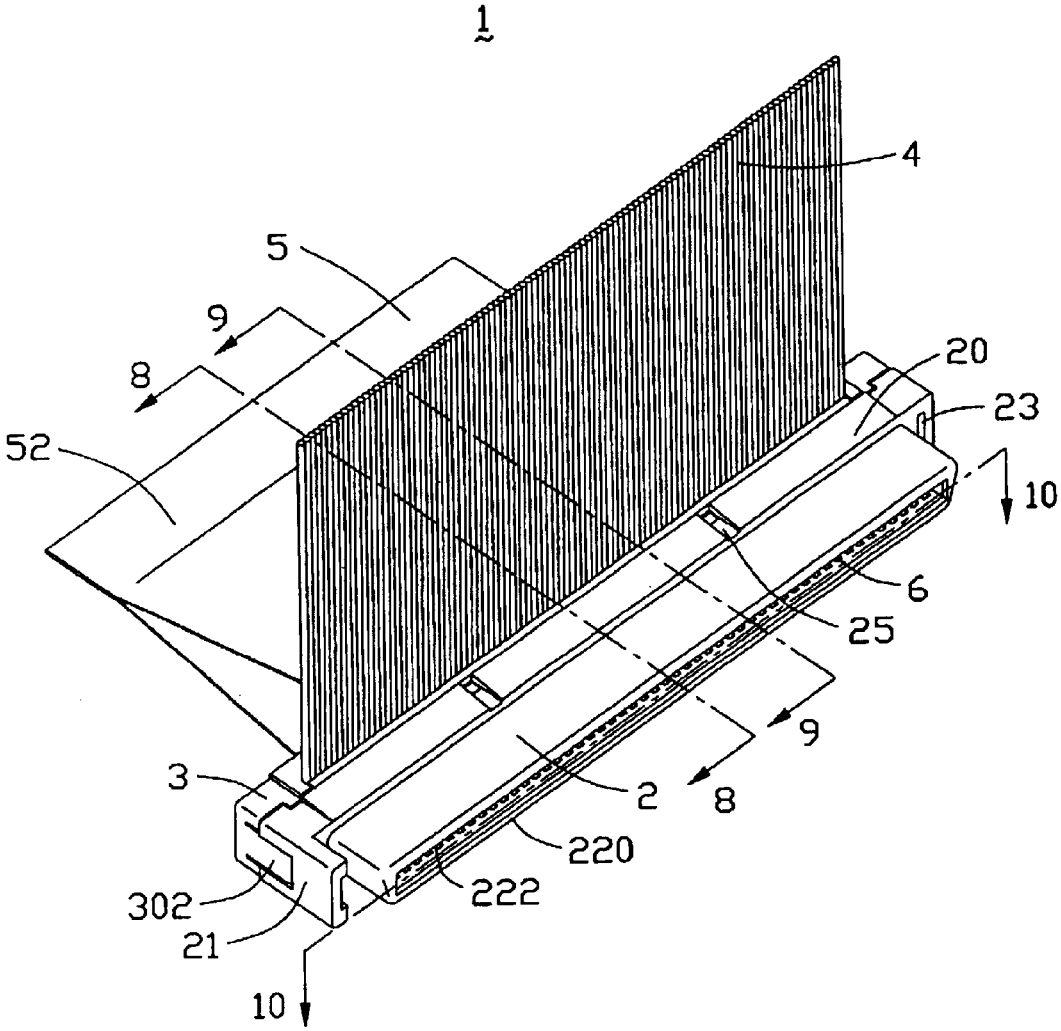
FIG. 5 is an assembled view of the cable end connector assembly of FIG. 1.
Figure 6:
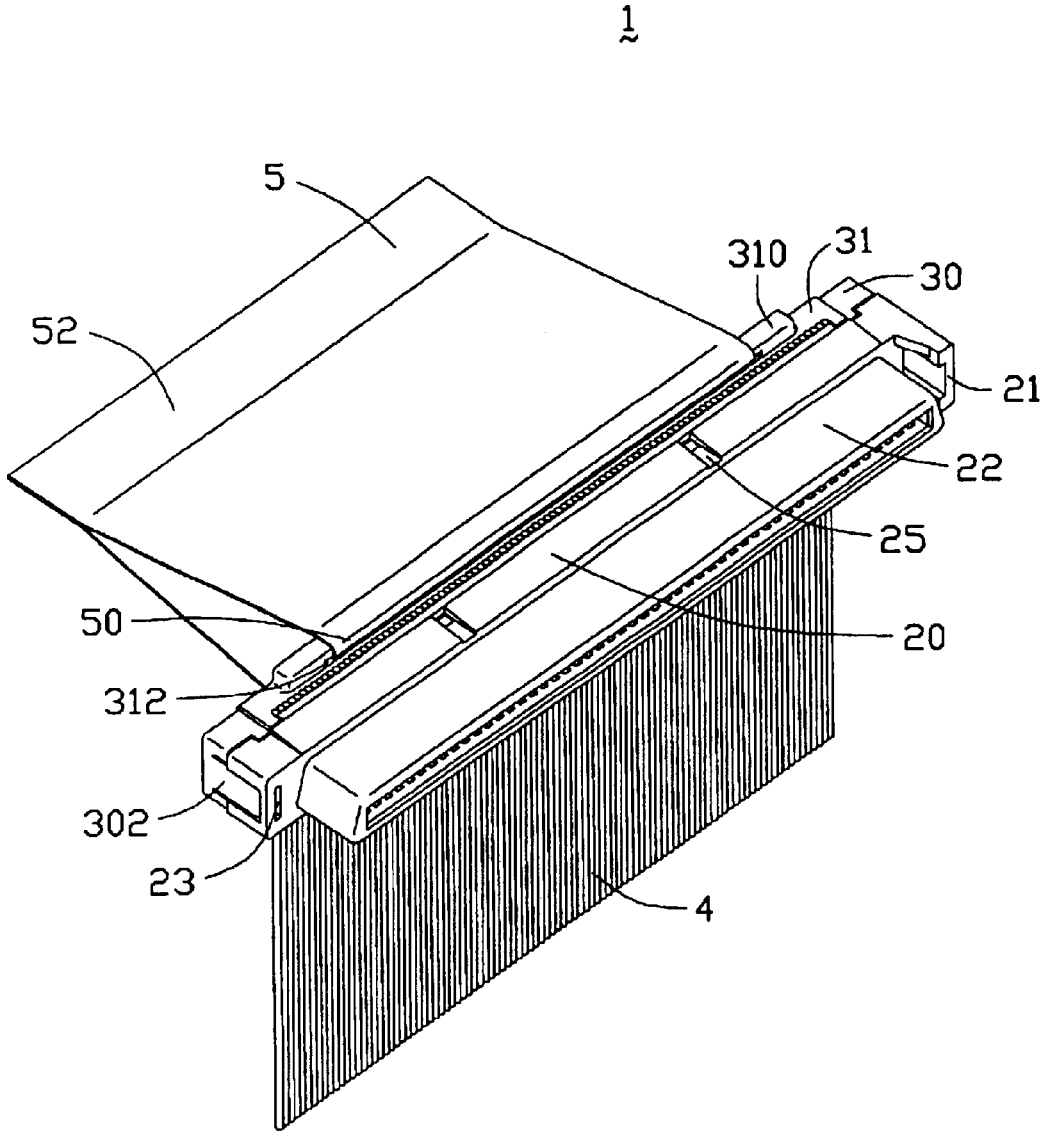
FIG. 6 is a view similar to FIG. 5, but taken from a different aspect.
Figure 7:
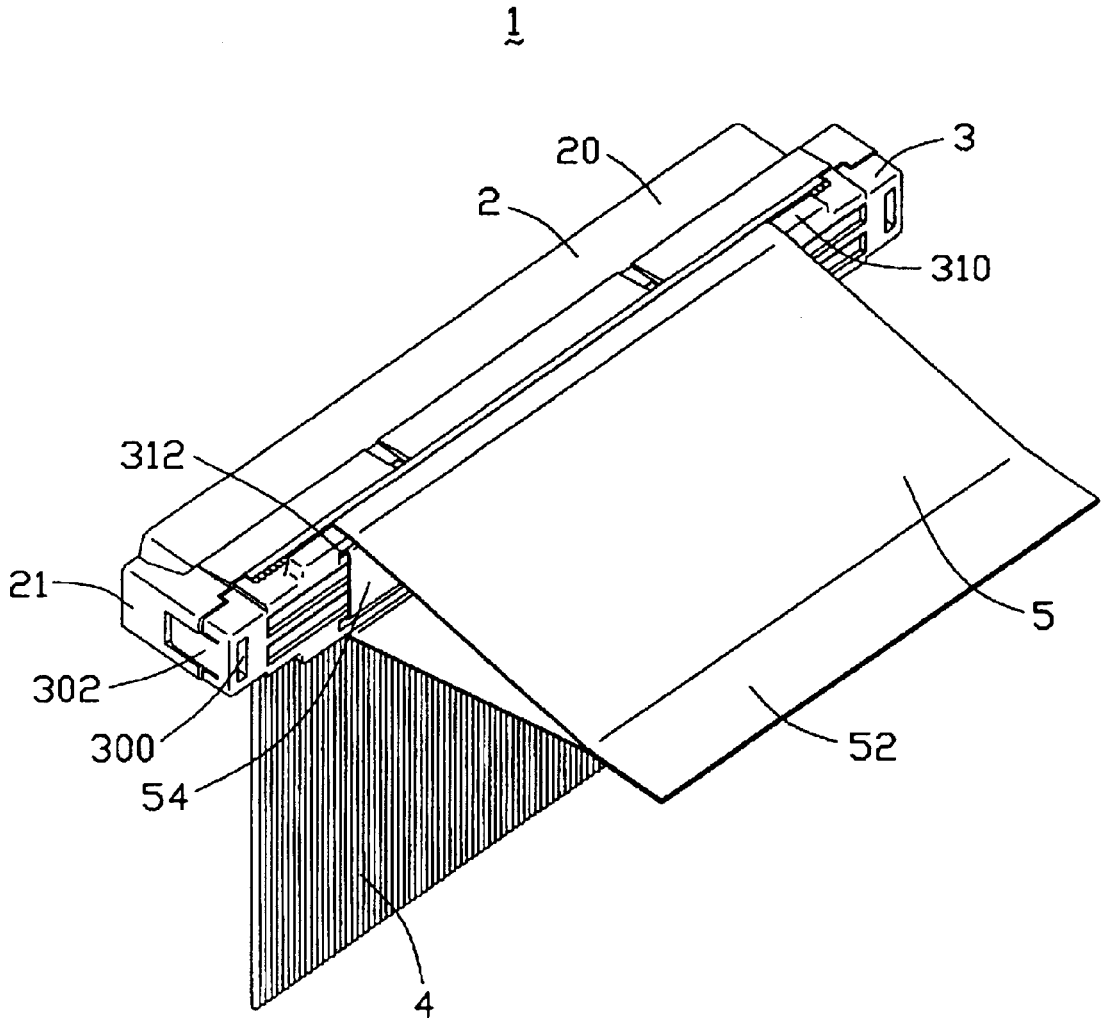
FIG. 7 is a view similar to FIG. 6, but taken from still another aspect.
Figure 8:
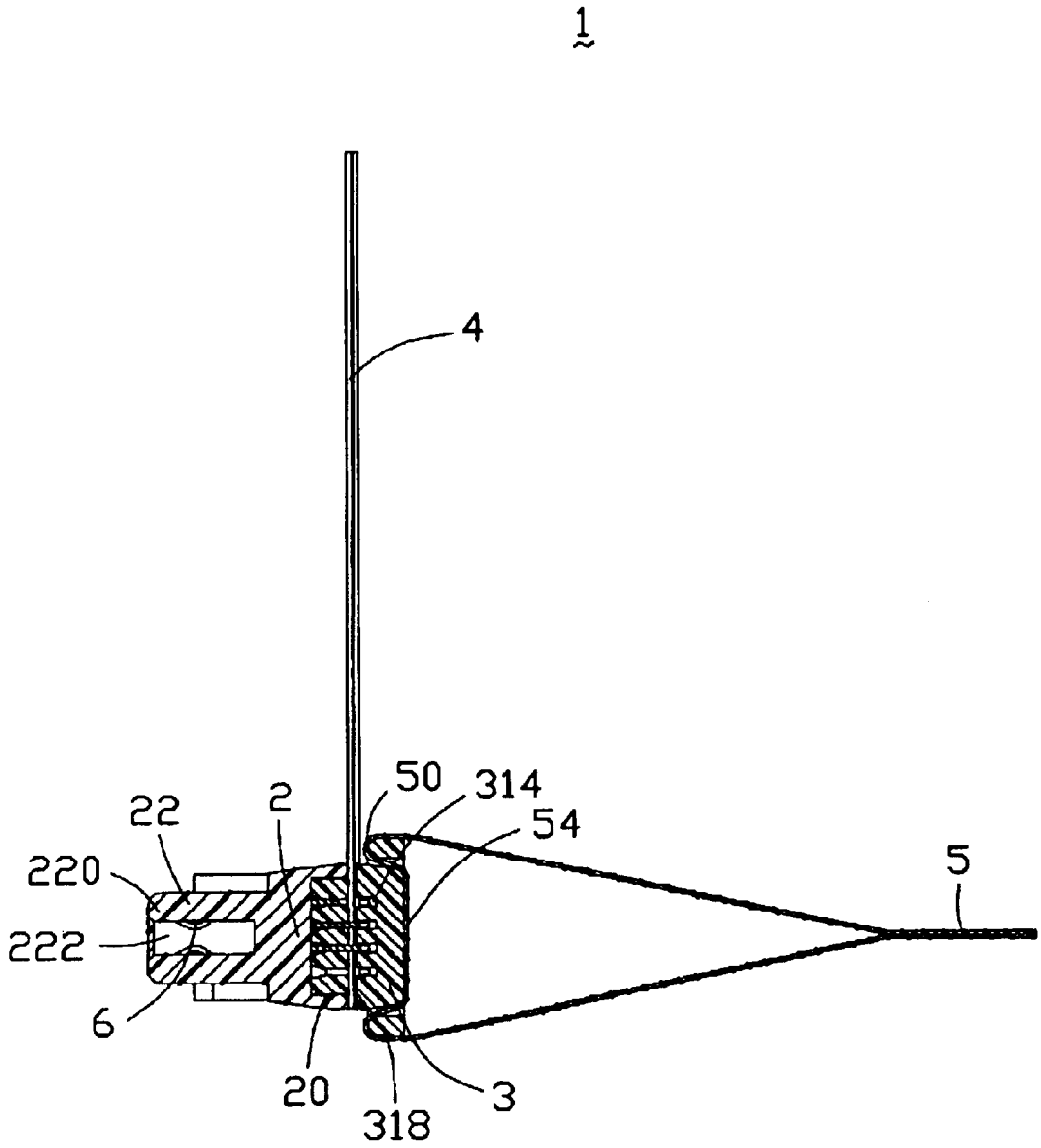
FIG. 8 is a cross-sectional view of the cable end connector assembly taken along line 8—8 of FIG. 5.

Referring to FIGS. 1–2, and in conjunction with FIGS. 3–4, the insulative cover 3 is made of insulative material such as plastic and comprises an elongated main body 31 and a pair of opposite ends 30 formed integrally with the main body 31. Each end 30 defines a recess 300 therethrough and forms a latch 302 extending outwardly along an outmost surface thereof. The main body 31 comprises a first face 316, an opposite second face 318, and a plurality of grooves 314 defined in the first face 316 thereof. A pair of ribs 310 extends outwardly from opposite side faces 313, 315 of the main body 31, respectively to form a pulling section for engaging with the pull tab 5. Each rib 310 defines a slot 312 along a longitudinal direction thereof and communicating with a corresponding upper surface 313 or lower surface 315 of the main body 31.

The cable 4 comprises a plurality of conductors 40 for respectively connecting to the electrical contacts 6.

Referring to FIGS. 5–10, in assembly, the cable 4 is terminated to the termination face 200 of the insulative housing 2 with the conductors 40 thereof electrically terminated with the insulation displacement portions 64 of the electrical contacts 6. The cover 3 is secured to the insulative housing 2 for preventing the cable 4 from separating from the electrical contacts 6. The pair of latches 302 of the cover 3 respectively latches with the first and the second retaining wedges 240, 242 by stages with the engaging portions 24 of the insulative housing 2 respectively received in the recesses 300 of the cover 3 for securing the cover 3 to the insulative housing 2. The conductors 40 of the cable 4 and the insulation displacement portions 64 of the contacts 6 are respectively received in the grooves 314 of the cover 3 (FIG. 9). The pull tab 5 is made of flexible plastic or plastic-like sheet material. In assembly, one end of the pull tab 5 first extends through the slot 312 defined in the rib 310 formed on the side face 313 of the cover 3, wraps the second face 308, and finally extends through the other slot 312 of the cover 3 to overlaps with the other end of the pull tab 5. Thus, the pull tab 5 forms a pair of receiving portions 50 respectively enclosing the pair of ribs 312, a flat portion 54 connected the pair of receiving portions 50 and wrapping the second face 308 of the cover 3, and an overlapped pulling portion 52 formed by the ends for being dragged by a user.

When the cable end connector assembly 1 is to be disengaged from the complementary connector, the user only needs to drag the pulling portion 52 of the pull tab 5. At that time, the receiving portions 50 of the pull tab 5 exert the dragging force on the ribs 310 with the flat portion 54 abutting against the second face 318 of the cover 3. Under the same dragging force for disengaging the cable end connector assembly 1 from the complementary connector, the pull tab 5 in accordance with the present invention distributes the dragging force to the pair of ribs 310 and the second face 318 of the cover 3. The contacting area between the pull tab 5 and the cover 3 is increased. Thus, the force exerted on each rib 310 of the cover 3 is reduced and the cover 3 is not easy to break down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end assembly, comprising:

an insulative housing;

a plurality of electrical contacts received in the insulative housing;

a cable electrically terminated with the electrical contacts;

an insulative cover assembled to the housing and comprising a first face engaging with the cable and a second face opposite to the first face; and a pull tab assembled to the cover and wrapping the second face of the cover.

2. The cable end assembly as claimed in claim 1, wherein the insulative cover has a pair of ribs respectively formed on a pair of side faces thereof, and wherein the pull tab engages with the ribs.

3. The cable end assembly as claimed in claim 2, wherein each rib defines a slot along a longitudinal direction of the housing, and wherein the pull tab extends through the slots to enclose the pair of ribs, and wraps the second face of the cover.

4. The cable end assembly as claimed in claim 1, wherein the insulative housing comprises a mating face and a termination face opposite to the mating face, and wherein the insulative housing defines a plurality of passageways extending from the termination face toward the mating face to receive the electrical contacts.

5. The cable end assembly as claimed in claim 4, wherein each electrical contact comprises a contacting portion received in a corresponding passageway of the insulative housing and an insulation displacement portion extending oppositely from the contacting portion and exposed beyond the termination face of the insulative housing to electrically connected with the cable.

6. The cable end assembly as claimed in claim 1, wherein the insulative housing comprises a base and a mating portion extending forwardly from the base, and wherein the mating portion is D-shaped.

7. The cable end assembly as claimed in claim 6, wherein the insulative housing comprises a guiding post extending from one end of the base and adapted for engaging with a complementary connector.

8. The cable end assembly as claimed in claim 6, wherein the insulative housing comprises a pair of engaging portions extending rearwardly from opposite ends of the base, and wherein the cover comprises a pair of latches extending forwardly therefrom to respectively engage with the pair of engaging portions of the insulative housing.

9. An IDC (Insulation Displacement Connection) cable end connector assembly, comprising:

an insulative housing;

a plurality of electrical contacts received in the insulative housing and each electrical contact comprising a mating portion and an opposite insulation displacement portion exposed outside the insulative housing;

a cable comprising a plurality of conductors respectively electrically connected with the insulation displacement portions of the electrical contacts;

a cover assembled to the insulative housing and comprising a first face engaging with the cable and a second face opposite to the first face, the cover forming a pulling section thereon; and a pull tab assembled to the cover and extending through the pulling section.

10. The IDC cable end assembly as claimed in claim 9, wherein the pulling section of the cover is a pair of ribs formed on a pair of parallel surfaces perpendicular to the first and the second faces of the cover, and wherein the pull tab protrudes through the ribs, respectively.

11. The IDC cable end assembly as claimed in claim 10, wherein each rib of the cover defines a slot therein, and wherein the pull tab protrudes through the slots to form a pair of receiving portions receiving the ribs and a flat portion connecting the receiving portions and abutting against the second face of the cover.

12. A cable end connector assembly comprising:

an insulative housing defining thereof a lengthwise direction and a lateral direction perpendicular to each other;

a plurality of contacts disposed in the housing, respectively;

a cable assembled to the housing and mechanically and electrically connected to the contacts;

an insulative cover cooperating with the housing to retain the cable therebetween;

a pair of laterally projecting pulling sections formed along two opposite elongated edges of said cover along said lengthwise direction, respectively; and a pull tab device assembled to the cover and substantially located above said cover, wherein said pull tab has a joint upper operation section with two split lower sections each applying an upward force only on each corresponding pulling section when the pulling force is applied on said joint upper operation section.

13. The assembly as claimed in claim 12 wherein each of said pulling sections defines an elongated slot, along said lengthwise direction, into which the lower section extends.

* * * * *